US009494321B2

(12) United States Patent
Melton et al.

(10) Patent No.: US 9,494,321 B2
(45) Date of Patent: Nov. 15, 2016

(54) WAKE REDUCING STRUCTURE FOR A TURBINE SYSTEM

(71) Applicant: General Electric Company, Schenectady, NY (US)

(72) Inventors: Patrick Benedict Melton, Horse Shoe, NC (US); Richard Martin DiCintio, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 381 days.

(21) Appl. No.: 14/102,006

(22) Filed: Dec. 10, 2013

(65) Prior Publication Data

US 2015/0159872 A1 Jun. 11, 2015

(51) Int. Cl.

| | |
|---|---|
| ***F23R 3/08*** | (2006.01) |
| ***F23R 3/06*** | (2006.01) |
| ***F23R 3/16*** | (2006.01) |
| ***F23R 3/28*** | (2006.01) |
| ***F23R 3/34*** | (2006.01) |

(52) U.S. Cl.

CPC . *F23R 3/08* (2013.01); *F23R 3/06* (2013.01); *F23R 3/16* (2013.01); *F23R 3/283* (2013.01); *F23R 3/346* (2013.01); *F23R 2900/00018* (2013.01); *F23R 2900/03043* (2013.01)

(58) Field of Classification Search

CPC ..... F23R 3/002; F23R 3/06; F23R 3/283; F23R 2900/03042; F23R 2900/03041; F02C 3/145; F01D 9/023

See application file for complete search history.

(56) References Cited

U.S. PATENT DOCUMENTS

| | | | | |
|---|---|---|---|---|
| 5,749,219 | A * | 5/1998 | DuBell | F02C 7/26 60/733 |
| 7,559,203 | B2 * | 7/2009 | Stastny | F23R 3/60 60/796 |
| 8,281,594 | B2 * | 10/2012 | Wiebe | F23D 11/36 60/733 |
| 8,522,557 | B2 | 9/2013 | Dawson et al. | |
| 8,899,975 | B2 * | 12/2014 | Khan | F23R 3/002 431/352 |

(Continued)

*Primary Examiner* — Phutthiwat Wongwian
*Assistant Examiner* — Stefan Ibroni
(74) *Attorney, Agent, or Firm* — Ernest G. Cusick; Frank A. Landgraff

(57) ABSTRACT

A wake reducing structure includes a combustor liner having an inner surface and an outer surface, the inner surface defining a combustor chamber. Also included is an airflow path located along the outer surface of the combustor liner. Further included is a wake generating component disposed in the airflow path and proximate the combustor liner, wherein the wake generating component generates a wake region located downstream of the wake generating component. Yet further included is a wake generating component boss operatively coupled to the combustor liner and disposed within a combustor liner aperture. Also included is a cooling channel extending through the wake generating component boss, the cooling channel having an air inlet on an upstream region of the wake generating component boss and an air outlet on a downstream region of the wake generating component boss, the cooling channel configured to supply air to the wake region.

18 Claims, 3 Drawing Sheets

FIG. 5

(56) References Cited

U.S. PATENT DOCUMENTS

| | | | | |
|---|---|---|---|---|
| 8,904,796 | B2 * | 12/2014 | Singh | F23R 3/045 60/733 |
| 8,919,127 | B2 * | 12/2014 | Melton | F23R 3/286 415/115 |
| 2010/0031665 | A1 * | 2/2010 | Chokshi | F01D 5/186 60/760 |
| 2010/0307161 | A1 * | 12/2010 | Thomson | F23D 11/107 60/748 |

* cited by examiner

WAKE REDUCING STRUCTURE FOR A TURBINE SYSTEM

BACKGROUND OF THE INVENTION

The subject matter disclosed herein relates to turbine systems and, more particularly, to a wake reducing structure for such turbine systems.

Combustor arrangements are often of a reverse-flow configuration and include a liner formed of sheet metal. The sheet metal and an outer boundary component, often referred to as a sleeve, form a path for air received from the compressor outlet to flow in a direction toward a head end of the combustor, where the air is then turned into nozzles and mixed with fuel in a combustor chamber. Various components that serve structural and functional benefits may be located along the airflow path. These components result in wake regions located proximate a downstream side of the components. These wake regions lead to pressure drops and non-uniform airflow as the air is provided to the nozzles at the head end, thereby leading to undesirable effects such as increased NOx emission and less efficient overall operation.

BRIEF DESCRIPTION OF THE INVENTION

According to one aspect of the invention, a wake reducing structure for a turbine system includes a combustor liner having an inner surface and an outer surface, the inner surface defining a combustor chamber. Also included is an airflow path located along the outer surface of the combustor liner. Further included is a wake generating component disposed in the airflow path and proximate the combustor liner, wherein the wake generating component generates a wake region located downstream of the wake generating component. Yet further included is a wake generating component boss operatively coupled to the combustor liner and disposed within a combustor liner aperture. Also included is a cooling channel extending through the wake generating component boss, the cooling channel having an air inlet on an upstream region of the wake generating component boss and an air outlet on a downstream region of the wake generating component boss, the cooling channel configured to supply air to the wake region of the wake generating component.

According to another aspect of the invention, a fuel injector assembly for a combustor assembly of a gas turbine engine includes a combustor liner having an outer surface. Also included is a sleeve surrounding the combustor liner at a radially outwardly spaced location. Further included is an airflow path defined by the outer surface of the combustor liner and the sleeve. Yet further included is a fuel injector disposed in the airflow path and extending at least partially through a combustor liner aperture and a sleeve aperture. Also included is a boss disposed in the airflow path and operatively coupled to a combustor liner aperture wall, the boss formed by an additive manufacturing process. Further included is a cooling channel extending through the boss, the cooling channel having an air inlet on an upstream region of the boss and an air outlet on a downstream region of the boss, the cooling channel configured to supply air to a wake region located downstream of the fuel injector.

According to yet another aspect of the invention, a gas turbine engine includes a compressor section, a turbine section, and a combustor assembly. The combustor assembly includes an airflow path defined by an outer surface of a combustor liner and a sleeve surrounding the combustor liner. The combustor assembly also includes a fuel injector disposed in the airflow path and extending at least partially through a combustor liner aperture and a sleeve aperture. The combustor assembly further includes a boss disposed in the airflow path and operatively coupled to a combustor liner aperture wall, the boss formed by an additive manufacturing process. The combustor assembly yet further includes a plurality of cooling channels extending through the boss, the plurality of cooling channels each having an air inlet on an upstream region of the boss and an air outlet on a downstream region of the boss, the plurality of cooling channels configured to supply air to a wake region located downstream of the fuel injector.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
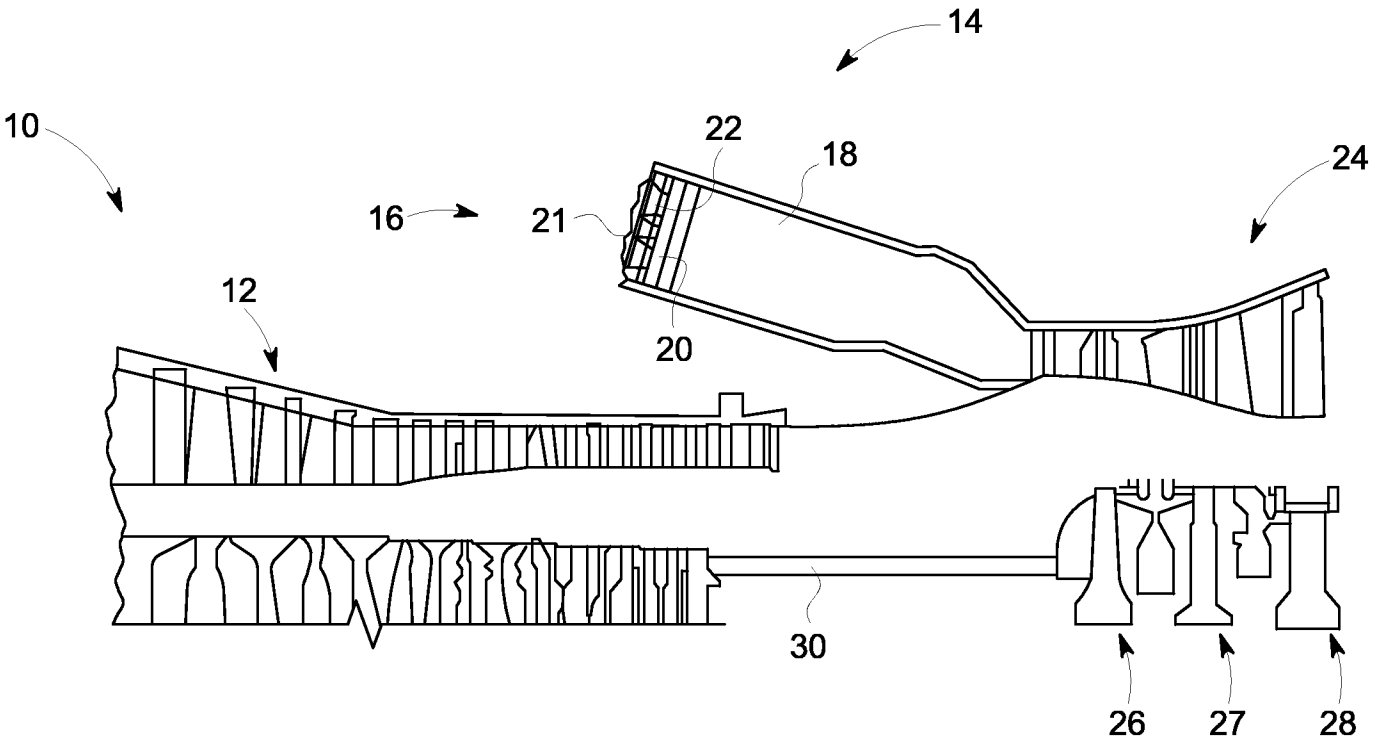
FIG. 1 is a schematic illustration of a gas turbine engine.

Referring to FIG. 1, a turbine system, such as a gas turbine engine 10, constructed in accordance with an exemplary embodiment of the present invention is schematically illustrated. The gas turbine engine 10 includes a compressor 12 and a plurality of combustor assemblies arranged in a can annular array, one of which is indicated at 14. As shown, the combustor assembly 14 includes an endcover assembly 16 that seals, and at least partially defines, a combustor chamber 18. A plurality of nozzles 20-22 are supported by the endcover assembly 16 and extend into the combustor chamber 18. The nozzles 20-22 receive fuel through a common fuel inlet (not shown) and compressed air from the compressor 12. The fuel and compressed air are passed into the combustor chamber 18 and ignited to form a high temperature, high pressure combustion product or air stream that is used to drive a turbine 24. The turbine 24 includes a plurality of stages 26-28 that are operationally connected to the compressor 12 through a compressor/turbine shaft 30 (also referred to as a rotor).

In operation, air flows into the compressor 12 and is compressed into a high pressure gas. The high pressure gas is supplied to the combustor assembly 14 and mixed with fuel, for example natural gas, fuel oil, process gas and/or synthetic gas (syngas), in the combustor chamber 18. The fuel/air or combustible mixture ignites to form a high pressure, high temperature combustion gas stream. In any event, the combustor assembly 14 channels the combustion gas stream to the turbine 24 which converts thermal energy to mechanical, rotational energy.

Figure 2:
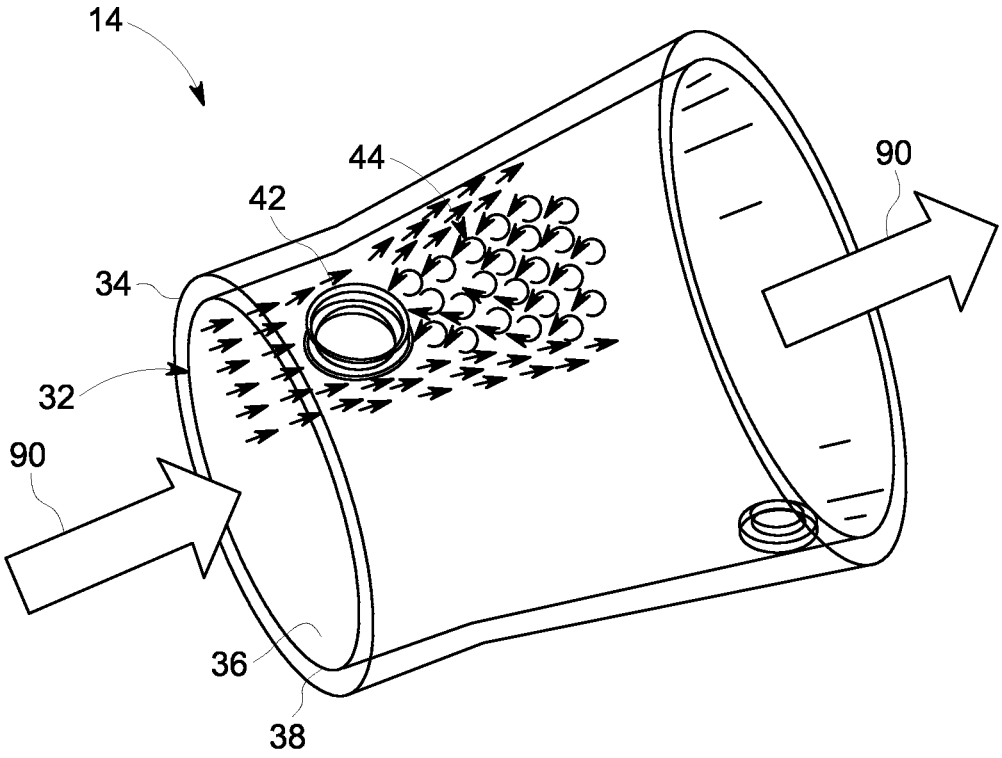
FIG. 2 is a perspective view of a portion of a combustor assembly of the gas turbine engine.
Figure 3:
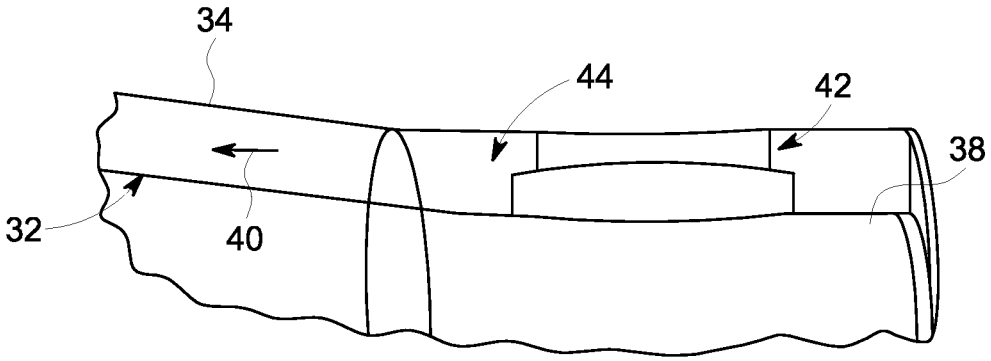
FIG. 3 is a side view of a portion of the combustor assembly illustrating a wake generating component.

Referring now to FIGS. 2 and 3, portions of the combustor assembly 14 are illustrated. As noted above, the combustor assembly 14 is typically one of several combustors operating within the gas turbine engine 10, which are often circumferentially arranged. The combustor assembly 14 is often tubular in geometry and directs the hot pressurized gas 90 into the turbine section 24 of the gas turbine engine 10.

As will be appreciated from the description below, the combustor assembly includes a liner that defines an interior region that may be a combustion zone or a transition zone. The particular embodiment described below for illustrative purposes relates to a combustor liner surrounded by a sleeve. However, it is to be appreciated that the embodiments of the invention described herein may be used in conjunction with various other embodiments of the combustor assembly 14. Specifically, a transition piece liner may be employed and surrounded by an impingement sleeve or by a single liner that surrounds the transition piece liner and the combustor liner. Furthermore, a single liner may be employed that defines the combustion zone and the transition zone. The single liner may or may not be surrounded by one or more sleeves.

In one embodiment, the combustor assembly 14 is defined by a combustor liner 32 which is at least partially surrounded at a radially outward location by an outer boundary component, such as a sleeve 34, for example. Specifically, the combustor liner 32 includes an inner surface 36 and an outer surface 38, where the inner surface 36 defines the combustor chamber 18. An airflow path 40 formed between the outer surface 38 of the combustor liner 32 and the sleeve 34 provides a region for an airstream to flow therein toward nozzles of the combustor assembly 14. Although illustrated and previously described as having the sleeve 34 surrounding the combustor liner 32, it is contemplated that only the combustor liner 32 is present, with the outer boundary component comprising an outer casing or the like. Disposed within, or partially protruding into, the airflow path 40 is at least one wake generating component 42. The wake generating component 42 generically refers to any structural member and may provide various structural and/or functional benefits to the gas turbine engine 10. In one embodiment, the wake generating component 42 comprises a fuel injector extending radially inwardly through the combustor liner 32, such as a late lean injector (LLI). Alternatively, the wake generating component 42 may be a tube such as a cross-fire tube that fluidly couples adjacent combustor chambers, a camera, etc. The preceding list is merely exemplary and it is to be understood that the wake generating component 42 may refer to any structural member disposed in the airflow path 40.

As air flowing within the airflow path 40 encounters the wake generating component 42, a wake region 44 is generated downstream of the wake generating component 42. Specifically, the wake region 44 may extend from immediately adjacent a downstream end of the wake generating component 42 to locations proximate the downstream end of the wake generating component 42.

Figure 4:
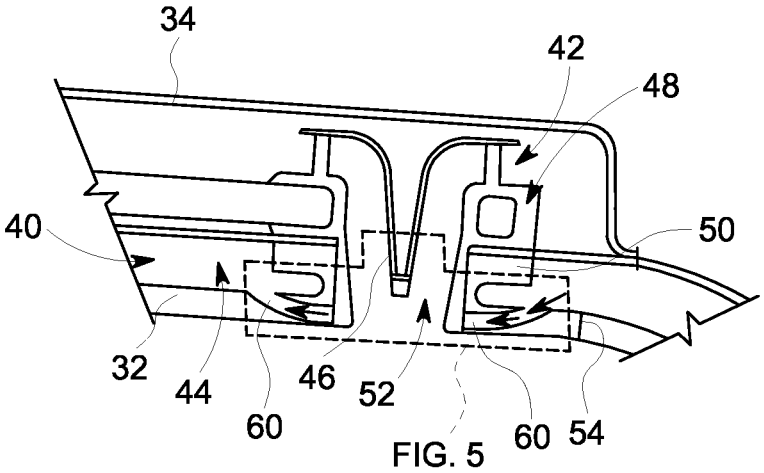
FIG. 4 is an enlarged side view of the wake generating component.
Figure 5:
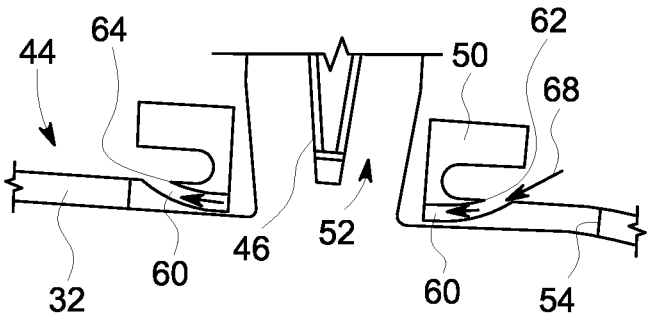
FIG. 5 is an enlarged side view of section V of FIG. 4, illustrating the wake generating component in greater detail.

Referring to FIGS. 4 and 5, the wake generating component 42 is illustrated in greater detail. Specifically, a LLI fuel injector assembly is illustrated as the embodiment of the wake generating component 42. The LLI fuel injector assembly is configured to inject fuel into the combustor chamber 18. The LLI fuel injector assembly includes an injector 46 and a structural support arrangement 48 that may be operatively coupled to the injector 46 or integrally formed with the injector 46. A boss 50 is included to locate and support the injector 46 within the airflow path 40. The boss 50 is operatively coupled to the combustor liner 32. In one embodiment, the boss 50 is positioned within a combustor liner aperture 52 and welded to a combustor liner aperture wall 54 that defines the combustor liner aperture 52.

The boss 50 of the LLI fuel injector assembly includes at least one, but typically a plurality of cooling microchannels 60 formed within the boss 50. The boss 50 and, more specifically, the plurality of cooling microchannels 60 form a wake reducing structure, as will be appreciated from the description below. The plurality of cooling microchannels 60 may be the same or different in size or shape from each other. In accordance with one embodiment, the plurality of cooling microchannels 60 may have a cross-section dimension (e.g., width, diameter, etc.) of between about 100 microns (μm) and about 3 millimeters (mm). The plurality of cooling microchannels 60 may have circular, semi-circular, oval, curved, rectangular, triangular, or rhomboidal cross-sections. The preceding list is merely illustrative and is not intended to be exhaustive. In certain embodiments, the plurality of cooling microchannels 60 may have varying cross-sectional areas. Heat transfer enhancements such as turbulators or dimples may be installed in the plurality of cooling microchannels 60 as well.

Each of the plurality of cooling microchannels 60 includes an air inlet 62 and an air outlet 64. The air inlet 62 is an opening in the boss 50 on the upstream region of the boss 50. Specifically, the air inlet 62 is located on an upstream side of the LLI fuel injector assembly. The air outlet 64 is an opening in the boss 50 on the downstream region of the boss 50. Each cooling microchannel continuously extends from the air inlet 62 to the air outlet 64 to provide a passage through the boss 50. An airflow 68 enters the air inlet 62 and is provided to the cooling microchannel for routing therethrough to the air outlet 64, which is located within the above-described wake region 44. The airflow 68 may be sourced directly from the airstream passing through the airflow path 40. Additionally, the airflow 68 may be sourced from a secondary air supply that is in fluid communication with the cooling microchannel. Regardless of the precise source of the airflow 68, suction of the airflow 68 through the cooling microchannel and into the wake region 44 is achieved due to the lower pressure of the wake region 44 relative to the region of the airflow path 40 located just upstream of the boss 50 (i.e., at the air inlet 62). As the airflow 68 is drawn through the cooling microchannel, the pulled air "fills-in" the wake region 44, thereby reducing undesirable effects associated with large wake regions.

Although it is contemplated that any conventional manufacturing process may be employed to form the plurality of cooling microchannels 60, and possibly the entire boss 50, one category of manufacturing process is particularly useful for forming the plurality of cooling microchannels 60. In particular, additive manufacturing may be employed to form the boss 50 and the plurality of cooling microchannels 60. The term "additively manufactured" should be understood to describe components that are constructed by forming and solidifying successive layers of material one on top of another. More specifically, a layer of powder material is deposited onto a substrate, and melted through exposure to heat, a laser, an electron beam or some other process and subsequently solidified. Once solidified, a new layer is deposited, solidified, and fused to the previous layer until the component is formed. Exemplary additive manufacturing processes include direct metal laser melting (DMLM) and direct metal laser sintering (DMLS).

Advantageously, airflow uniformity is increased as the airstream is routed to the head end nozzles, which promotes increased overall efficiency of the gas turbine engine 10, as well as reduced NOx emission. Additionally, the airflow 68 passing through the plurality of microchannels 60 cools the boss 50 secured to the combustor liner 32.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A wake reducing structure for a turbine system comprising:

a combustor liner having an inner surface and an outer surface, the inner surface defining a combustor chamber;

a sleeve at least partially surrounding the combustion liner;

an airflow path located along the outer surface of the combustor liner and between the combustion liner and the sleeve;

a wake generating component disposed in the airflow path and proximate the combustor liner, wherein the wake generating component generates a wake region, in the air flow path, located downstream of the wake generating component;

a wake generating component boss operatively coupled to the combustor liner and disposed within a combustor liner aperture; and a cooling channel extending through the wake generating component boss, the cooling channel having an air inlet on an upstream region of the wake generating component boss and an air outlet on a downstream region of the wake generating component boss, the cooling channel air outlet configured to supply air to the wake region of the wake generating component.

2. The wake reducing structure of claim 1, wherein the wake generating component comprises a fuel injector.

3. The wake reducing structure of claim 1, wherein the wake generating component boss is formed by an additive manufacturing process.

4. The wake reducing structure of claim 3, wherein the additive manufacturing process comprises direct metal laser melting (DMLM).

5. The wake reducing structure of claim 3, wherein the additive manufacturing process comprises direct metal laser sintering (DMLS).

6. The wake reducing structure of claim 1, wherein the wake generating component boss is welded to the combustor liner.

7. The wake reducing structure of claim 1, further comprising a plurality of cooling channels extending through the wake generating component boss.

8. A fuel injector assembly for a combustor assembly of a gas turbine engine comprising:

a combustor liner having an outer surface;

a sleeve surrounding the combustor liner at a radially outwardly spaced location;

an airflow path defined by the outer surface of the combustor liner and the sleeve and between the combustion liner and the sleeve;

a fuel injector disposed in the airflow path and extending at least partially through a combustor liner aperture and a sleeve aperture;

a boss disposed in the airflow path, the boss disposed within a combustor liner aperture and operatively coupled to a combustor liner aperture wall, the boss formed by an additive manufacturing process; and a cooling channel extending through the boss, the cooling channel having an air inlet on an upstream region of the boss and an air outlet on a downstream region of the boss, the cooling channel air outlet configured to supply air to a wake region, in the air flow path, located downstream of the fuel injector.

9. The fuel injector assembly of claim 8, wherein the additive manufacturing process comprises direct metal laser melting (DMLM).

10. The fuel injector assembly of claim 8, wherein the additive manufacturing process comprises direct metal laser sintering (DMLS).

11. The fuel injector assembly of claim 8, wherein the boss is welded to the combustor liner aperture wall.

12. The fuel injector assembly of claim 8, further comprising a plurality of cooling channels extending through the boss.

13. The fuel injector assembly of claim 8, wherein the cooling channel comprises a diameter ranging from about 100 micrometers (μm) to about 3 millimeters (mm).

14. A gas turbine engine comprising:

a compressor section;

a turbine section; and a combustor assembly comprising:

an airflow path defined by an outer surface of a combustor liner and a sleeve surrounding the combustor liner and between the combustion liner and the sleeve;

a fuel injector disposed in the airflow path and extending at least partially through a combustor liner aperture and a sleeve aperture;

a boss disposed in the airflow path, the boss disposed within a combustor liner aperture, and operatively coupled to a combustor liner aperture wall, the boss formed by an additive manufacturing process; and a plurality of cooling channels extending through the boss, the plurality of cooling channels each having an air inlet on an upstream region of the boss and an air outlet on a downstream region of the boss, the air outlet of each of the plurality of cooling channels configured to supply air to a wake region, in the air flow path, located downstream of the fuel injector.

15. The gas turbine engine of claim 14, wherein the additive manufacturing process comprises direct metal laser melting (DMLM).

16. The gas turbine engine of claim 14, wherein the additive manufacturing process comprises direct metal laser sintering (DMLS).

17. The gas turbine engine of claim 14, wherein the boss is welded to the combustor liner aperture wall.

18. The gas turbine engine of claim 14, wherein each of the plurality of cooling channels comprise a diameter ranging from about 100 micrometers (μm) to about 3 millimeters (mm).

* * * * *